US005788108A

United States Patent [19]

Rohr

[11] Patent Number: 5,788,108

[45] Date of Patent: Aug. 4, 1998

[54] DISPENSING CLOSURE WITH RETRACTABLE LID

[75] Inventor: Robert D. Rohr, Eagle, Wis.

[73] Assignee: AptarGroup, Inc., Crystal Lake, Ill.

[21] Appl. No.: 565,821

[22] Filed: Dec. 1, 1995

[51] Int. Cl.[6] ..... B65D 43/16; B65D 43/20; B65D 47/00

[52] U.S. Cl. ..... 220/331; 215/238; 220/229; 220/254; 220/334; 220/347; 222/556

[58] Field of Search ..... 215/238, 241, 215/242, 235; 220/331, 229, 244, 254, 334, 347, 345, 335, 338; 222/556

[56] References Cited

U.S. PATENT DOCUMENTS

| | | | |
|---|---|---|---|
| 1,289,917 | 12/1918 | Robinson . | |
| 2,757,859 | 8/1956 | Holland | 220/254 X |
| 4,609,124 | 9/1986 | Malloy | 220/331 X |
| 4,730,363 | 3/1988 | Asbaghi | 220/331 X |
| 5,065,886 | 11/1991 | Sher | 220/331 |
| 5,067,624 | 11/1991 | Thanisch | 220/254 X |
| 5,115,928 | 5/1992 | Drummond, Jr. | 215/221 X |
| 5,203,469 | 4/1993 | Chang et al. . | |
| 5,271,531 | 12/1993 | Rohr et al. . | |
| 5,285,917 | 2/1994 | Hofmann | 215/224 X |
| 5,353,947 | 10/1994 | Zinnbauer et al. . | |
| 5,462,189 | 10/1995 | Pierce | 220/331 X |

*Primary Examiner*—Allan N. Shoap
*Assistant Examiner*—Niki M. Kopsidas
*Attorney, Agent, or Firm*—Dressler, Rockey, Milnamow & Katz, Ltd.

[57] ABSTRACT

A closure is provided for the opening to a container interior. The closure includes a body for mounting to the container at the opening. The body defines a dispensing passage for communicating between the container exterior and interior. The body also defines a recess, and the closure includes a lid movable between a closed position covering the dispensing passage and an open position wherein the lid is retracted into the recess in a storage orientation permitting the dispensing of the container contents.

27 Claims, 6 Drawing Sheets

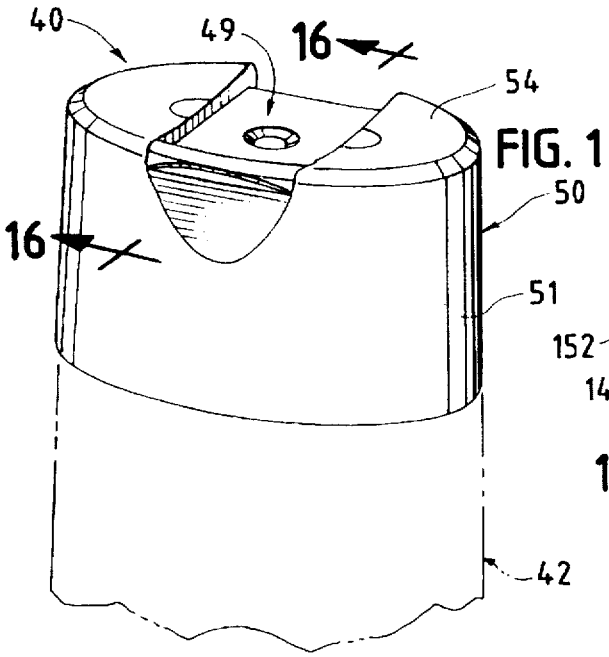
FIG. 1
FIG. 3
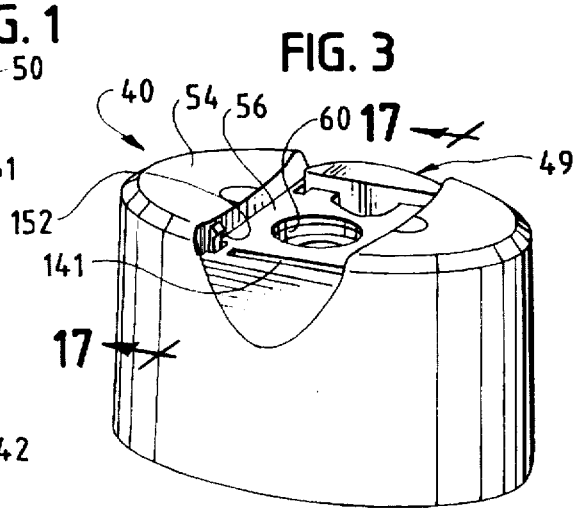
FIG. 2
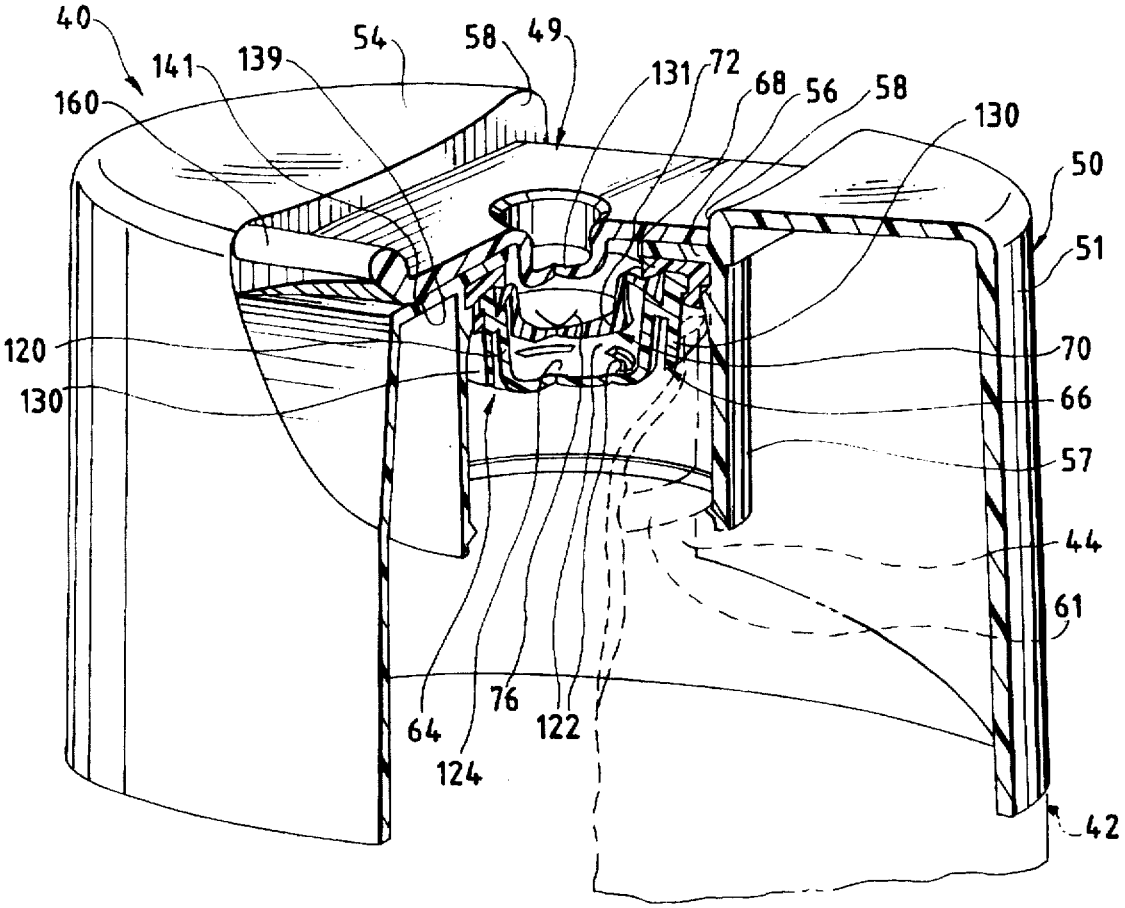

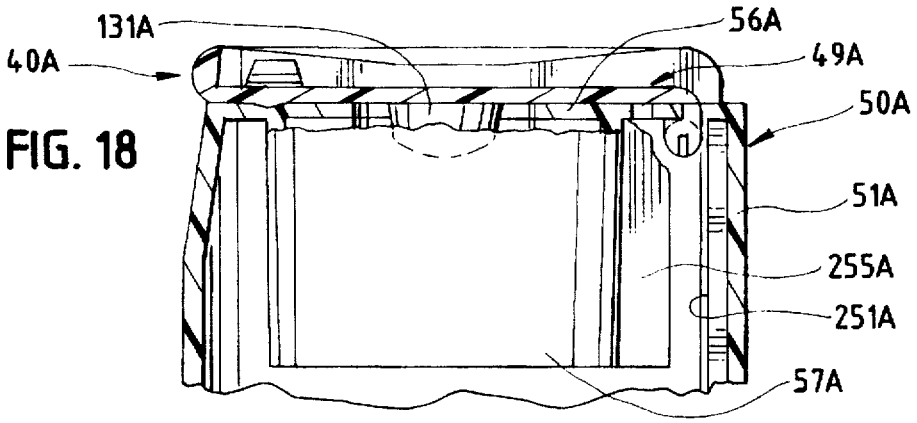
FIG. 18
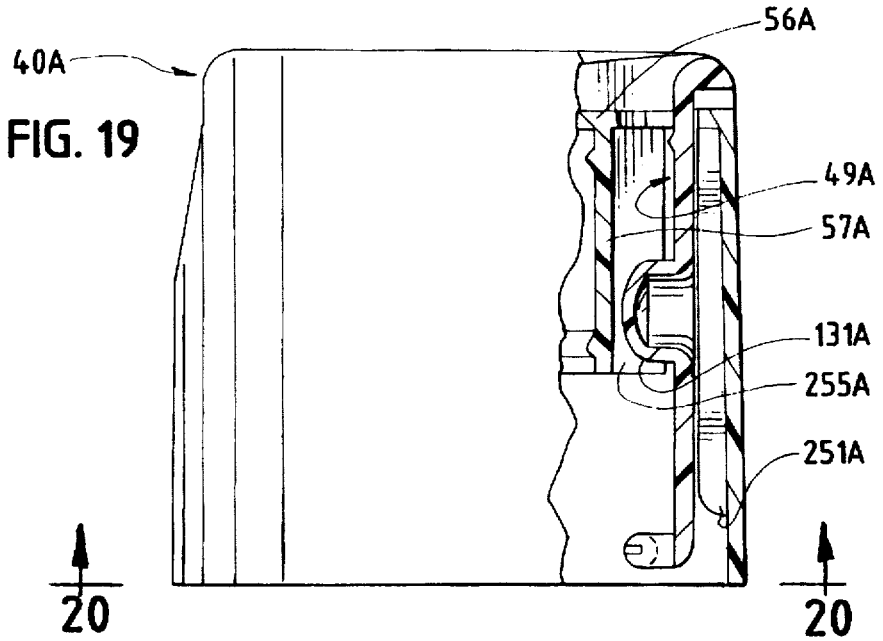
FIG. 19
FIG. 20
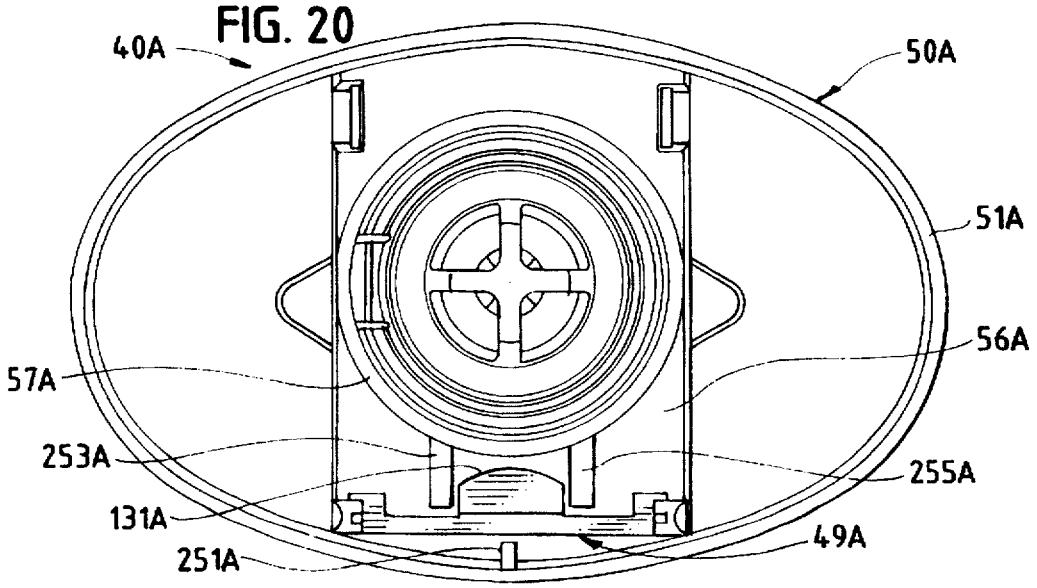

DISPENSING CLOSURE WITH RETRACTABLE LID

TECHNICAL FIELD

This invention relates to container closures. The invention is particularly suitable for use with a squeeze-type container dispensing closure having a valve which opens to dispense a fluid product from the container when the container is squeezed and which automatically closes when the squeezing pressure is released.

BACKGROUND OF THE INVENTION AND TECHNICAL PROBLEMS POSED BY THE PRIOR ART

A variety of packages, including dispensing packages or containers, have been developed for personal care products such as shampoo, lotions, etc., as well as for other fluid materials. One type of closure for these kinds of containers typically has a flexible, self-sealing, slit-type dispensing valve mounted over the container opening. When the container is squeezed, the fluid contents of the container are discharged through the valve.

Closure designs have been proposed for such valves, and examples are illustrated in the U.S. Pat. No. 5,271,531. Typically, the closure includes a base or housing defining a seat for receiving the valve and includes a retaining ring or clamp structure for holding the valve on the seat in the housing.

The closure base can be provided with a lid for covering the valve during shipping and when the container is otherwise not in use. See, for example, FIGS. 31–34 of U.S. Pat. No. 5,271,531. Such a lid can be designed to prevent leakage from the valve under certain conditions. The lid can also keep the valve clean and/or protect the valve from damage. However, the presence of the lid when open may be objectionable to some users in some applications.

It would be desirable, therefore, to provide an improved closure lid system that could be even more conveniently used with a dispensing valve wherein the open lid could be maintained in a non-interfering storage position. It would also be advantageous to provide such an improved closure lid for use over a dispensing passage that does not even employ such a valve.

It would be particularly desirable to provide such an improved closure wherein the open lid could be disposed in a substantially hidden orientation or position within the closure.

Additionally, it would be beneficial if the closure components could be provided with an improved system for mounting the lid and for readily accommodating the assembly of the components during manufacture of the closure.

Further, it would be advantageous if such an improved closure could provide means for preventing discharge of the container contents through a slit-type dispensing valve during over-pressure events, such as when the container is subjected to high impact forces that might cause the valve to open.

It would also be desirable to provide an improved closure which could function without a dispensing valve and which could even be used on containers of non-fluid articles (e.g., pills).

Additionally, it would be desirable if such an improved closure could be provided with a design that would accommodate efficient, high quality, large volume manufacturing techniques with a reduced product reject rate.

Further, such an improved closure should advantageously accommodate its use with a variety of conventional containers having a variety of conventional container finishes, such as conventional threaded or snap-fit attachment configurations.

The present invention provides an improved closure which can accommodate designs having the above-discussed benefits and features.

SUMMARY OF THE INVENTION

According to the present invention, a closure is provided for an opening to a container interior. The closure includes a body for mounting to the container at the opening. The body defines a dispensing passage for communicating between the container exterior and the interior. The body defines a recess for receiving a lid. The lid is movable between a closed position for covering the dispensing passage in the body and an open position wherein the lid is retracted into the recess in a storage orientation permitting the dispensing of the container contents.

When the lid is in the retracted, storage position, it is substantially hidden from view, and the contents can be readily dispensed from the container without the lid interfering with the discharge flow of the contents. Compared with conventional closures having lids which project exteriorly of the closure when open, the closure of the present invention is more aesthetically pleasing in the open condition because the lid is retracted within the closure. However, when the lid is in the closed position, the lid can provide a seal over the dispensing passage.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same, FIG. 1 is a perspective view of a first embodiment of a closure of the present invention shown with the lid closed;

FIG. 2 is a perspective view similar to FIG. 1, but FIG. 2 is greatly enlarged and shows the closure with portions cut away to illustrate interior detail;

FIG. 3 is a perspective view of the closure illustrated in FIG. 1, but the closure is shown in FIG. 3 with the lid in the open position;

FIG. 18 is a view similar to FIG. 16, but FIG. 18 shows a second embodiment of the closure with the lid closed;

FIG. 19 is a view similar to FIG. 17, but FIG. 19 shows the second embodiment of the closure with the lid in the open position;

FIG. 20 is a bottom plan view taken generally along the plane 20—20 in FIG. 19;

DESCRIPTION OF THE PREFERRED EMBODIMENTS

Figure 4:
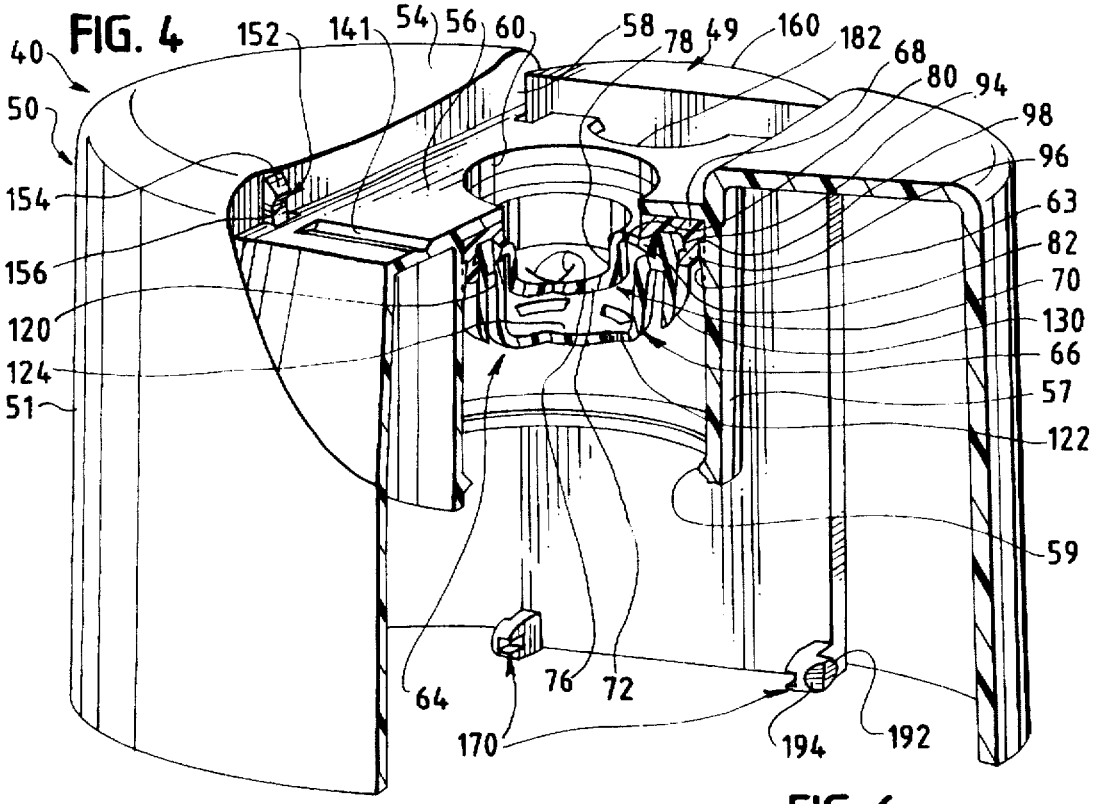
FIG. 4 is a perspective view similar to FIG. 2, but FIG. 4 shows the lid in the open position.

While this invention is susceptible of embodiment in many different forms, this specification and the accompanying drawings disclose only some specific forms as examples of the invention. The invention is not intended to be limited to the embodiments so described, and the scope of the invention will be pointed out in the appended claims.

For ease of description, the closure of this invention is described in various positions, and terms such as upper, lower, horizontal, etc., are used with reference to these positions. It will be understood, however, that the closure components may be manufactured and stored in orientations other than the ones described.

With reference to the figures, a first embodiment of a closure of the present invention is illustrated in FIGS. 1–17 and is represented generally in many of those figures by reference numeral 40. The closure 40 is adapted to be disposed on a container, such as a container 42 (FIGS. 1) which has a conventional mouth or opening formed by a neck 44 (FIG. 2) or other suitable structure. The neck 44 typically has a round cross-sectional configuration, but the body of the container 42 may have another cross-sectional configuration, such as the oval cross-sectional shape illustrated in FIGS. 1 and 2. The closure 40 may be fabricated from a thermoplastic material, or other materials, compatible with the container contents.

The container 42 may be normally stored and used in the orientation shown in FIG. 1 wherein the closure 40 is at the top of the container 42. The container 42 may also be stored in an inverted position (not illustrated). When stored in the inverted position, the container 42 employs the closure 40 as a support base.

The container 42 is a squeezable container having a flexible wall or walls which can be grasped by the user and compressed to increase the internal pressure within the container so as to squeeze the product out of the container when the closure is opened (as explained in detail hereinafter). The container wall typically has sufficient, inherent resiliency so that when the squeezing forces are removed, the container wall returns to its normal, unstressed orientation.

The closure 40 includes a hollow housing, base, or body 50 to which is mounted a lid 49. In the illustrated embodiment, the body 50 includes a peripheral sidewall 51. The wall 51 has a generally oval cross-sectional configuration to match the oval configuration of the body of the container 42. The wall 51 may have other configurations if desired.

Figure 5:
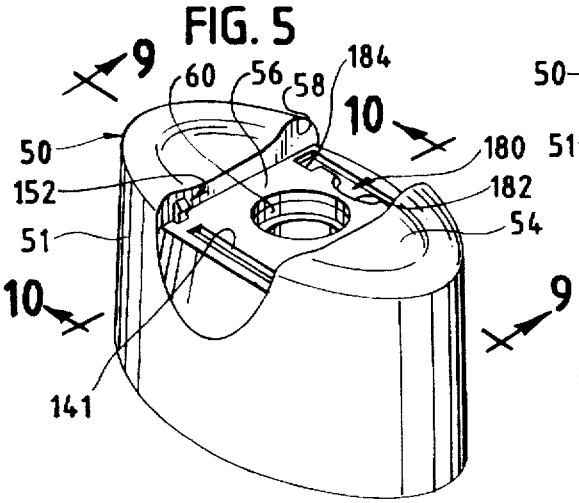
FIG. 5 is a view similar to FIG. 3, but FIG. 5 shows the closure body with the lid and internal valve cartridge completely removed therefrom.

As illustrated in FIGS. 4–8, the closure base 50 has an upper wall or surface 54 and a recessed, central deck 56. Vertical, spaced-apart, parallel walls 58 join opposing margins of the deck 56 to the upper wall or surface 54. As shown in FIGS. 5 and 9, the deck 56 defines a dispensing passage 60, and the dispensing passage 60 establishes communication between the exterior of the closure body deck 56 and the interior of the closure body 50.

As illustrated in FIGS. 4 and 9, a collar 57 projects downwardly from the underside of the closure body deck 56. The collar 57 is generally cylindrical and has a conventional snap-fit bead 59 or other suitable means (e.g., a conventional thread (not illustrated)) for engaging suitable cooperating means, such as a bead 61 on the container neck 44 (FIG. 2) to secure the closure body 50 to the container 42.

In the preferred embodiment illustrated, the dispensing passage 60 has a circular configuration, and the cylindrical collar 57 is concentrically disposed with respect to the dispensing passage 60.

The interior surface of the collar 57 has three, circumferentially spaced-apart, inwardly projecting retention shoulders or ribs 63 (two of which are visible in FIG. 9). The ribs 63 receive and retain in snap-fit engagement a standardized cartridge 64 (FIGS. 2 and 4) which contains a dispensing valve 70 (FIGS. 2 and 4). FIGS. 5–10 do not show the cartridge 64 or lid 49 because FIGS. 5–10 illustrate the closure body 50 prior to assembly of the cartridge 64 and lid 49 on the body 50.

With reference to FIG. 4, it can be seen that the cartridge 64 is retained under, and against the underside of, the closure body deck 56. The cartridge 64 includes a body 66 and a cover or retainer 68. In the preferred embodiment illustrated, the body 66 and retainer 68 are molded from a suitable thermoplastic material and are snap-fit together to engage and retain the valve 70. In the preferred embodiment illustrated, the valve 70 is of a known design employing a flexible, resilient material with slits defining petals that open to dispense fluid.

The valve 70 may be fabricated from thermosetting elastomeric materials such as silicone, natural rubber, and the like. It is also contemplated that the valve 70 may be fabricated from thermoplastic elastomers based upon materials such as thermoplastic propylene, ethylene, urethane, and styrene, including their halogenated counterparts. A preferred form of the valve 70 is disclosed in the U.S. Pat. No. 5,439,143. The description of the valve disclosed in the U.S. Pat. No. 5,439,143 is incorporated herein by reference to the extent pertinent and to the extent not inconsistent herewith.

As illustrated in FIG. 4, the valve 70 includes a flexible, central wall 72 which has an outwardly concave configuration and which defines at least one, and preferably two, dispensing slits 76 extending through the central wall 72. A preferred form of the valve 70 has two, mutually perpendicular, intersecting slits 76 of equal length. The intersecting slits 76 define four, generally sector-shaped, flaps or petals in the concave, central wall 72. The flaps open outwardly from the slit intersection point in response to increasing pressure of sufficient magnitude in the well-known manner described in the U.S. Pat. No. 5,439,143.

The valve 70 includes a skirt 78 (FIGS. 4 and 17) which extends outwardly from the valve central wall 72. At the outer (upper) end of the skirt 78 there is a thin, annular flange 80 (FIGS. 6 and 7) which extends peripherally from the skirt 78 in a downwardly angled orientation. The thin flange 80 terminates in an enlarged, much thicker, peripheral flange 82 which has a generally dovetail shape transverse cross section.

To accommodate the seating of the valve 70 in the cartridge 64, the underside of the cartridge cover or retainer 68 defines an annular, downwardly facing, angled clamping surface for engaging the top of the valve flange 82. The bottom of the valve flange 82 is engaged by an annular shoulder in the cartridge body 66 which defines an upwardly angled seating surface.

The spacing between the retainer clamping surface and the body 66 seating surface increases with increasing radial distance from the center of the valve 70. Such a configuration defines a cavity with a transverse cross section having a dovetail shape which generally conforms to the cross-sectional shape of the valve flange 82.

This clamping arrangement securely holds the valve 70 in the cartridge 64 without requiring special internal support structures or bearing members adjacent the interior surface of the valve cylindrical skirt 78. This permits the region adjacent the interior surface of the valve skirt 78 to be substantially open, free, and clear so as to accommodate movement of the valve skirt 78.

Figure 17:
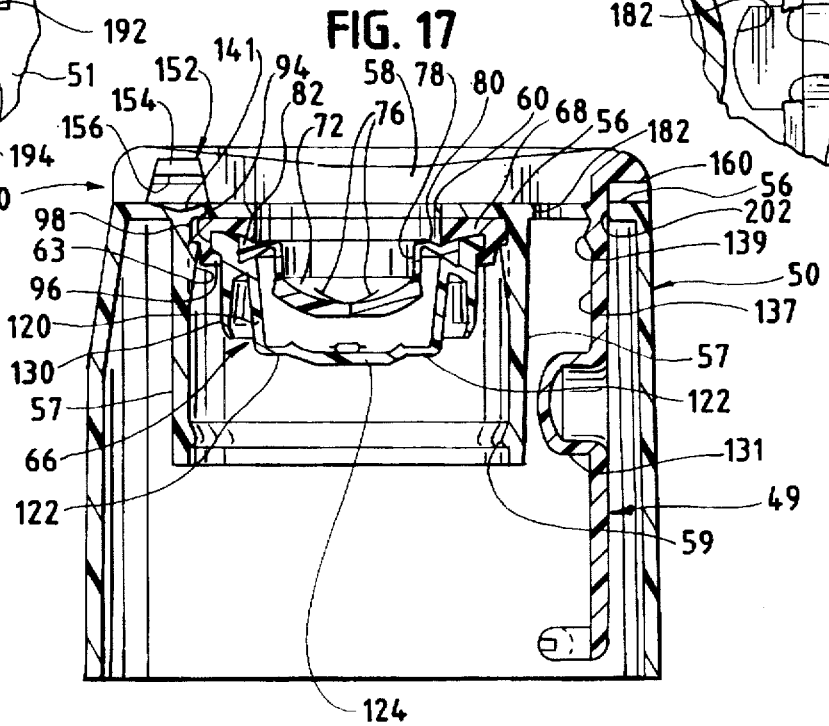
FIG. 17 is an enlarged, cross-sectional view taken generally along the plane 17—17 in FIG. 3.

When the valve 70 is properly mounted within the cartridge body 66 as illustrated in FIGS. 4 and 17, the valve 70 is recessed relative to the outer, top surface of the retainer 68. This affords substantial protection of the valve 70 and generally reduces the likelihood that the valve will be inadvertently contacted or damaged by external instrumentalities when the closure is opened but not dispensing the container contents. However, when the container contents are dispensed through the valve 70 (as described in detail in the U.S. Pat. No. 5,439,143), the valve central wall 72 is forced outwardly from the recessed position.

The cartridge body 66 and retainer 68 have exterior configurations permitting the retainer and body to be held together in the clamping configuration around the valve 70 (FIGS. 4 and 17). In particular, the cartridge body 66 has an annular shoulder 94 extending radially outwardly around the periphery of the upper edge of the cartridge body 66. The retainer 68 has a radially inwardly projecting lip 96 for receiving the body shoulder 94 in a snap-fit engagement to securely clamp the valve flange 82.

The assembled cartridge 64 (with clamped valve 70) can then be installed in the closure base 50 by pushing the cartridge 64 into the open bottom of the collar 57. The cartridge 64 is adapted to be engaged with, and retained in, the closure housing collar 57. To this end, the retainer 68 has an outwardly projecting, annular bead 98 (FIGS. 4 and 17) for being received in a snap-fit engagement over the shoulders or ribs 63 inside the collar 57. The installed cartridge 64 is disposed within the housing 50 so that the cartridge 64 is adjacent the central deck 56.

Preferably, the cartridge 64 also includes a downwardly extending wall 120 (FIGS. 2 and 17). Projecting radially inwardly from the distal end of the wall 120 are four arms 122 (two of which are visible in FIGS. 2 and 17) which support a centrally disposed baffle plate 124. The arms 122 are circumferentially spaced at 90° increments.

The cartridge 64 also includes an outer seal wall 130 (FIGS. 2 and 17). As illustrated in FIG. 2, the exterior surface of the seal wall 130 is received within the container neck 44 and seals against the cylindrical interior surface of the neck 44. Preferably, at least a distal annular portion of the seal wall 130 is somewhat resilient so as to provide a leak-tight seal between the cartridge 64 and the container neck 44.

The lid 49 is adapted to be moved between a closed position (illustrated in FIG. 2) and an open position (illustrated in FIG. 4). When the lid 49 is in the open position, the product within the container 42 can be dispensed from the container by squeezing the container sufficiently to force the product through the valve 70. Typically, this is effected by first inverting or tilting the container 42 so that the valve 70 is oriented to discharge generally downwardly. Typically, the liquid within the container flows downwardly, under the influence of gravity, and fills the container neck region. The liquid flows past the baffle 124 and against the inside of the valve central wall 72. When the valve 70 is subjected to sufficient increased container pressure, the valve central wall 72 is displaced outwardly as the valve flexible skirt 78 deflects outwardly. When the valve central wall 72 has moved outwardly so that it is substantially adjacent the closure body dispensing passage 60, the slits 76 begin to open to dispense the product (as described in detail in the U.S. Pat. No. 5,439,143).

When the lid 49 is in the closed position (as illustrated in FIGS. 2 and 17), the valve 70 is prevented from opening when the container (whether upright or inverted) is squeezed (either purposefully or accidentally) by a special inwardly projecting protuberance 131 (FIG. 1) on the lid 49. This protuberance 131 prevents the valve central wall 72 from moving or articulating sufficiently outwardly to open the dispensing slits 76. This is especially useful in preventing unwanted product leakage through the valve 70 which might otherwise occur in some circumstances. For example, there could be a tendency for the container contents to be forced through the valve 70 if the external pressure were suddenly reduced (e.g., during transport in an airplane) or if the container were subjected to an external impact force during shipping or handling. The protuberance 131 projects inwardly into the dispensing passage 60 sufficiently far to limit the outward movement of the valve central wall 72 during such a pressure differential condition. The outward movement of the central wall 72 is stopped by the protuberance 131 on the closed lid 49 before the valve slits 76 can begin to open.

Although the lid 49 must be open to permit dispensing of the container contents, the valve 70 is preferably designed so that when the container is inverted while the lid 49 is open, the weight of the container contents will not deflect the valve wall 72 outwardly under normal, static conditions, and the valve slits 76 will thus not open unless the container 42 is also squeezed.

It will be appreciated that the baffle plate 124 functions to minimize undesirable impacts on the inside of the valve 70, as when the container is being squeezed excessively hard or shaken. The baffle plate 124 also functions in this manner even when the closure lid 49 is in the closed position.

A variety of different sizes and shapes of containers can be readily provided with the closure 40 having a standardized cartridge 64. The cartridge 64, including the valve 70, can be provided in one, universal design having a standard shape and standard dimensions. The inside of the closure housing collar 57 can be provided with a receiving region of a standard shape and size for such a standard cartridge 64.

Figure 16:
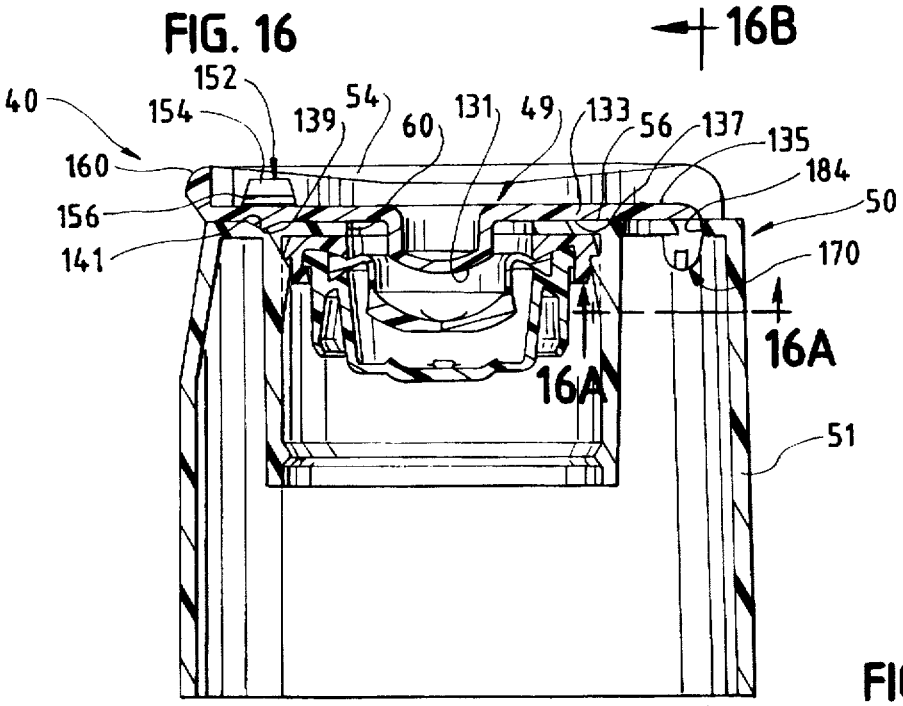
FIG. 16 is an enlarged, cross-sectional view taken generally along the plane 16—16 in FIG. 1.

A preferred form of the lid 49 is illustrated in FIGS. 11–15. The lid 49 includes a generally planar, central portion 133 having an upper surface 135 and a lower surface 137. As illustrated in FIG. 16, the upper surface 135 is recessed somewhat below the closure housing upper surface 54 when the lid 49 is closed. The lid lower surface 137 overlies the closure body deck 56 when the lid is in the closed position as shown in FIG. 16.

Figure 14:
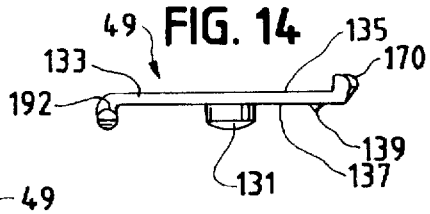
FIG. 14 is a left side elevational view of the lid taken generally along the plane 14—14 in FIG. 13.
Figure 13:
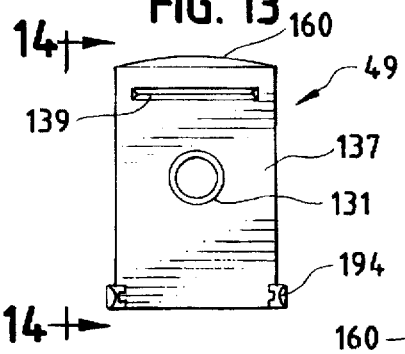
FIG. 13 is a bottom plan view taken generally along the plane 13—13 in FIG. 12.
Figure 12:
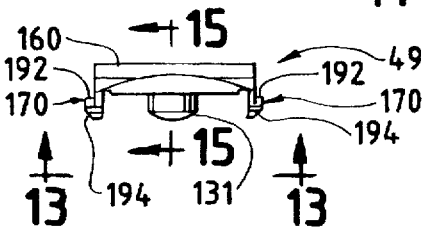
FIG. 12 is a front, elevational view taken generally along the plane 12—12 in FIG. 11.
Figure 15:
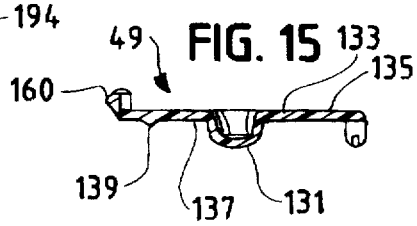
FIG. 15 is a cross-sectional view taken generally along the plane 15—15 in FIG. 12.

The lid 49 has a rib 139 projecting downwardly from the lower surface 137 as illustrated in FIGS. 13 and 14. As shown in FIG. 5, the closure body deck 56 defines a V-shaped groove 141, and as illustrated in FIGS. 2 and 16, the lid rib 139 is received in the groove 141 when the lid 49 is closed.

Figure 6:
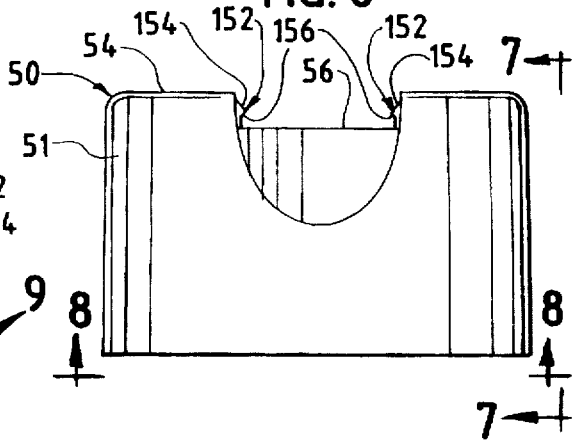
FIG. 6 is a front elevational view of the closure body illustrated in FIG. 5.

The lid 49 is held in the closed position by snap-fit latch arrangement which includes a portion 152 of each vertical wall 58 projecting outwardly over the deck 56 as shown in FIG. 6. As shown in FIG. 16, when the lid 49 is in the closed position, the projecting wall portion 152 on each vertical wall 58 overlies an adjacent peripheral edge of the lid 49 to hold the lid 49 in place. As can be seen in FIGS. 4, 6, and 17, each projecting portion 152 has a slanted upper surface 154 to guide the lid 49 into position over the deck 56 in the closed position. As the lid 49 is forced downwardly into the closed position, the slanted surface 154 of each projecting wall portion 152 is cammed or deflected outwardly a small amount. At the same time, or alternatively, the lid 49 may become slightly bowed (e.g., concave upwardly) so as to reduce its lateral dimension. In any event, sufficient, temporary deformation of the components permits the lid 49 to be moved below the bottom of the slanted surface 154 of each projecting wall portion 152.

A downwardly angled surface 156 of each wall portion 152 defines an angled shoulder overlying the adjacent, upper side edge of the lid 49 to hold the lid 49 in the closed position in a snap-fit engagement. Because the surface 156 is angled in the direction opposite from the upper surface 154, the lid 49 can be opened by lifting it upwardly with sufficient force to move past the projecting wall portion 152.

Figure 16A:
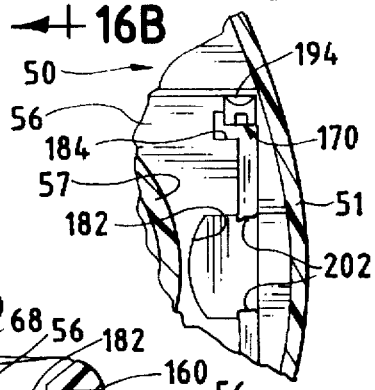
FIG. 16A is a fragmentary cross-sectional view taken generally along the plane 16A—16A in FIG. 16.
Figure 16B:
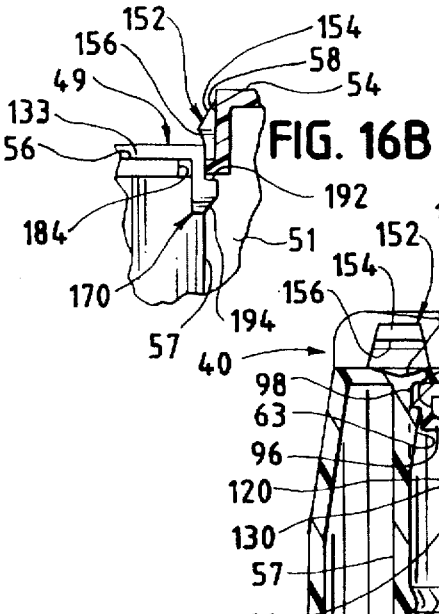
FIG. 16B is a fragmentary cross-sectional view taken generally along the plane 16B—16B in FIG. 16.

To assist in opening and closing the lid 49, the front of the lid defines an upwardly or outwardly projecting lift tab 160. The lift tab 160 is adapted to be grasped between the index finger and thumb so that the front end of the lid 49 can be lifted upwardly as the lid 49 is initially swung or pivoted about its rear end. The rear end of the lid 49 is received in a unique manner in the closure body 50 to accommodate the initial upward swinging of the lid 49 and subsequent movement of the lid 49 to the fully opened position illustrated in FIGS. 4 and 17. To this end, the rear end of the lid 49 has two spaced-apart legs 170 (FIG. 12) which are received in the rear portion of the closure body 50 as illustrated in FIGS. 16, 16A, and 16B.

The closure body 50 is provided with a unique configuration for receiving the lid legs 170. In particular, with reference to FIG. 10, the closure body deck 56 has an opening 180 which communicates with the recess below the deck 56 that is defined between the closure body sidewall 51 and interior collar 57. As illustrated FIG. 5, the opening 180 has the form of a generally elongate slot with an enlarged central portion 182 for accommodating the lid protuberance 131 when the lid is lowered through the deck 56 into the retracted, fully opened position illustrated in FIG. 17.

With reference to FIG. 5, each end of the slot or opening 180 in the deck 56 defines a generally rectangular aperture 184 for receiving one of the lid legs 170. When the lid 49 is in the closed position (FIGS. 16, 16A, and 16B), the lid legs 170 project downwardly through the apertures 184 and extend below the deck 56.

When the lid 49 is in the closed position (FIG. 16), a portion of each leg 170 projecting through the aperture 184 extends laterally beneath an adjacent portion of the deck 56 to hold the rear end of the lid on the closure body 50. To this end, each leg 170 has a unique configuration as illustrated in FIGS. 2 and 11–15. In particular, with reference FIG. 12, at the bottom of each leg 170 there is a laterally projecting foot with an upper semi-cylindrical surface 192 and a lower, slanted surface 194.

The lower, slanted surface 194 accommodates initial assembly of the lid 49 to the closure body 50. In particular, during assembly, the rear end of the lid 49 is positioned with the legs 170 in registry with the closure body deck apertures 184. The lid 49 is pushed downwardly so that the lower, slanting surfaces 194 of the legs 170 initially engage the outer sides of the apertures 184. This causes each leg 170 to be deflected inwardly so that the legs can pass through the apertures 184. When the lid 49 has been pushed down to the elevation where its bottom surface 137 engages the top of the deck 56, the legs 170 are free to spring back outwardly under the deck 56 to the original, substantially vertical orientation. In this orientation, as illustrated in FIGS. 16A and 16B, the upper semi-cylindrical surface 192 of each leg foot lies under the deck 56 adjacent the aperture 184. This prevents the lid 49 from being removed from the closure body 50 (unless access is gained to the underside of the closure body, and the legs 170 are pushed inwardly as the lid 49 is lifted upwardly).

The upper, semi-cylindrical surface 192 of the foot of each leg 170 permits the lid 49 to be lifted upwardly at the front end and to be swung or pivoted to a substantially vertical orientation. The semicylindrical surface 192 can engage the underside of the deck 56 to define a pivot axis along the line of contact between the surface 192 and the underside of the deck 56.

After the lid 49 is swung to a substantially vertical orientation, the lid 49 can then be lowered into the recess defined between the closure body sidewall 51 and the interior collar 57 below the deck 56. The opening or aperture 182 accommodates passage of the lid protuberance 131 so that the lid 49 can assume a substantially vertical, fully retracted position as shown in FIG. 17.

The lid lift tab 160 engages the upper surface of the deck 56 when the lid 49 is fully retracted, and the lid 49 hangs in that position by virtue of the engagement between the lid lift tab 160 and the deck 56.

Figure 8:
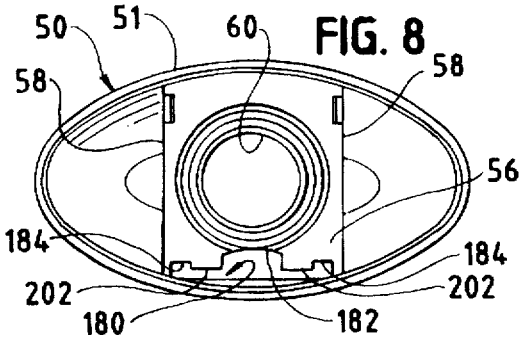
FIG. 8 is a bottom plan view taken generally along the plane 8—8 in FIG. 6.
Figure 7:
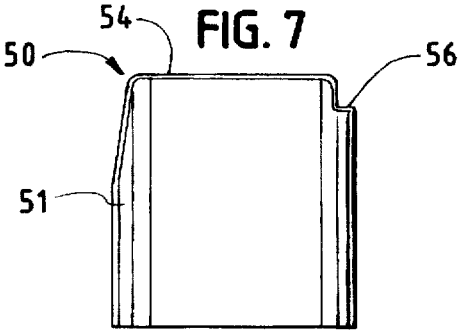
FIG. 7 is a right side elevational view of the closure body taken generally along the plane 7—7 in FIG. 6.
Figure 9:
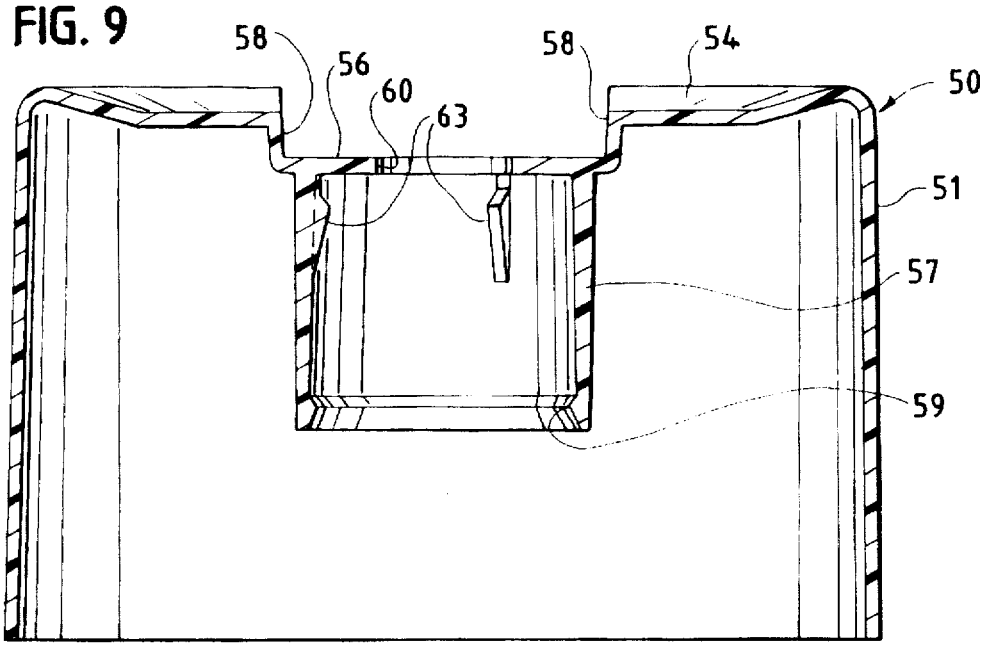
FIG. 9 is an enlarged, cross-sectional view taken generally along the plane 9—9 in FIG. 5.
Figure 10:
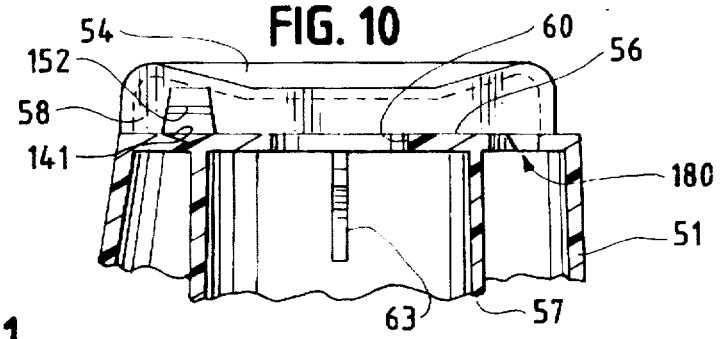
FIG. 10 is a fragmentary, cross-sectional view taken generally along the plane 10—10 in FIG. 5.
Figure 11:
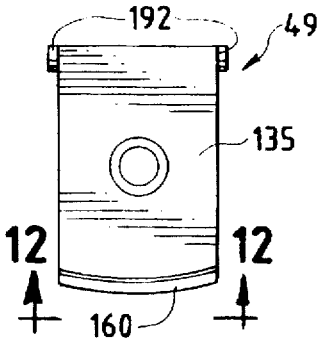
FIG. 11 is a top plan view of the closure lid shown apart from the closure body.

As illustrated in FIG. 8, the opening 180 in the deck 56 has two narrow slot portions 202. These narrow slot portions 202 are just slightly larger than the thickness of the planar portion of the lid 49. Thus, as illustrated in FIG. 17, the lid 49 is held in the slots 202 in the vertical, retracted orientation so that the lift tab 160 cannot be moved forwardly (to the left as viewed in FIG. 17) to become disengaged from the underlying portion of the deck 56.

Further, in a preferred embodiment, lid 49 has a slight lateral taper from front to back so that the front of the lid 49 is slightly wider than the rear of the lid 49. Thus, when the lid 49 is swung open to a vertical orientation and then pushed down into the retracted position below the closure body deck 56, the sides of the lid 49 begin to engage the sides of the lid leg receiving apertures 184. Sufficient interference is provided so that when the lid 49 is in the fully retracted position (FIGS. 4 and 17), there is enough frictional engagement between the sides of the wider front part of the lid 49 and the closure body 50 to hold the lid in the retracted, vertical orientation even when the closure (and container to which the closure is mounted) is inverted, as when the container contents are being dispensed.

Further, the rib 139 on the lid bottom surface 137 (FIG. 13) may also function to prevent the lid 49 from falling out of the retracted, open position when the closure and container are inverted. As shown in FIG. 17, the lid rib 139 is positioned below the closure body deck 56 when the lid 49 is in the fully retracted position. In order for the rib 139 to pass through the narrow slots 202 as the lid 49 moves from the closed position to the fully retracted position, the adjacent portions of the deck 56 are temporarily deflected slightly downwardly and forwardly. This temporarily increases the width of the slots 202 slightly so that the rib 139 can move below the deck 56. When the rib 139 has moved below the deck 56, the adjacent portion of the deck 56 returns to the original, undeflected position over the rib 139 and adjacent the lid vertical surface 137 above the rib 139. This serves to retain the lid 49 in the retracted, open position.

When it is desired to close the lid 49, the lift tab 160 is grasped and the lid is pulled vertically upwardly. The rib 139 on the lid 49 causes the portions of the deck 56 adjacent the lid to deflect upwardly and forwardly a small amount so that the rib 139 can pass through the narrow slots or apertures 202. The lid 49 is pulled upwardly until the laterally projecting feet of the legs 170 engage the underside of the deck 56. At this point, the lid 49 can be swung downwardly on top of the deck 56 in the fully closed position as illustrated in FIG. 16.

A second embodiment of the closure of the present invention is illustrated in FIGS. 18–20 and is designated therein generally by the reference numeral 40A. The closure 40A includes a closure body 50A and a lid 49A. The lid 49A and closure body 50A each has a structure substantially identical with that described above for the lid 49 and closure body 50, respectively, of the first embodiment illustrated in FIGS. 1–17. However, the closure body 50A of the second embodiment illustrated in FIGS. 18–20 includes a special guide rail system for further guiding the movement of the lid 49A as it is lowered into the closure body 50A to the retracted, open position illustrated in FIG. 19.

Specifically, the closure body 50A includes a sidewall 51A which, at the rear of the closure body, has a central guide rail 251A projecting inwardly. This guides the lid top surface as the lid is lowered.

Two additional guide rails, 253A and 255A, project rearwardly from the interior collar 57A and downwardly from the deck 56A. The rails 253A and 255A serve to guide the lid protuberance 131A which slides between the two rails 253A and 255A.

Figure 21:
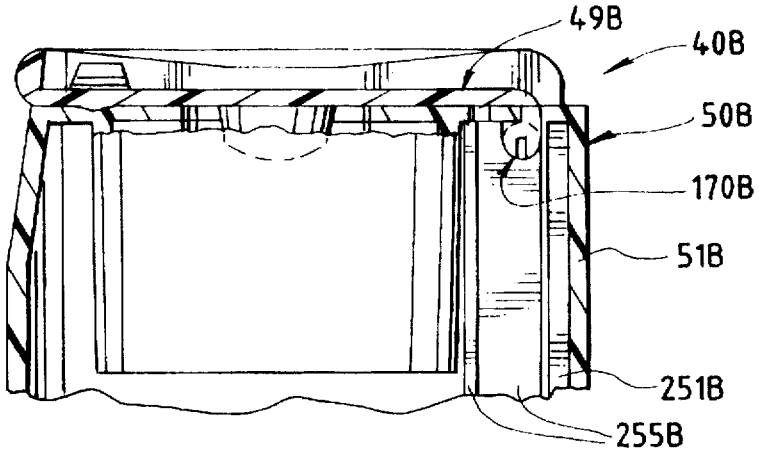
FIG. 21 is a view similar to FIG. 18, but FIG. 21 shows a third embodiment of the closure of the present invention with the lid in the closed position.
Figure 22:
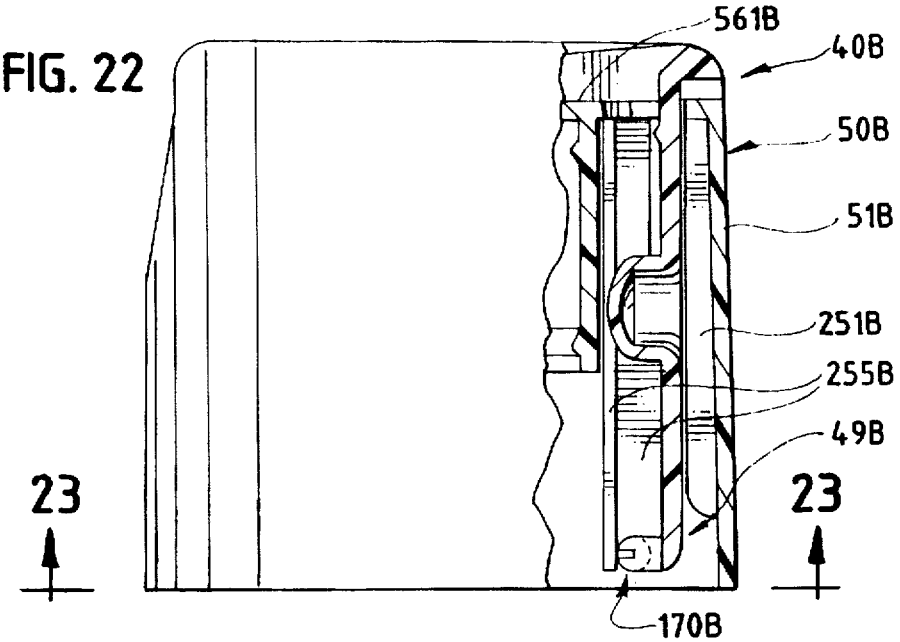
FIG. 22 is a view similar to FIG. 21, but FIG. 22 shows the lid in the open position.
Figure 23:
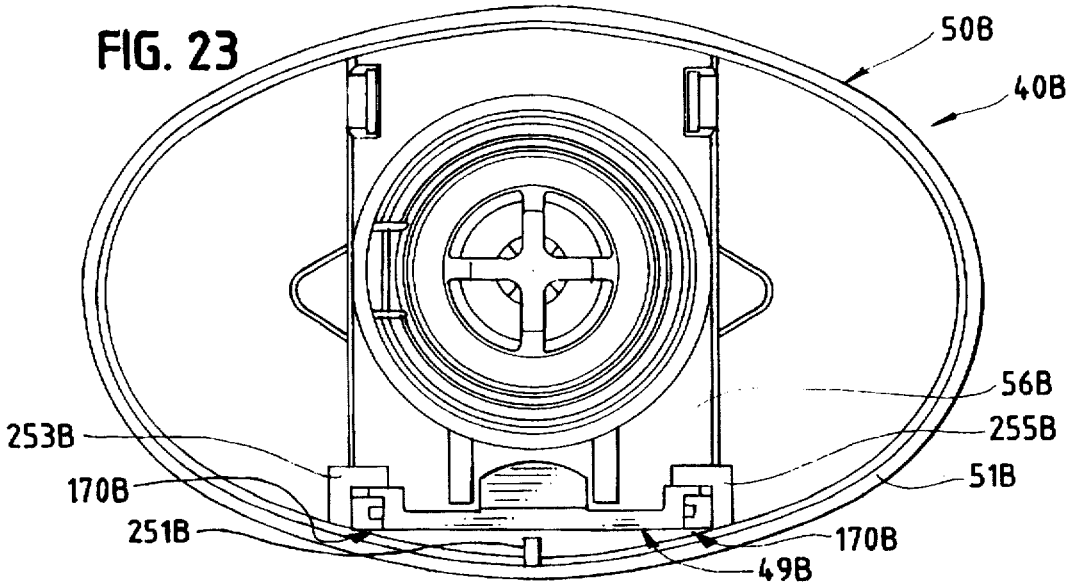
FIG. 23 is a bottom plan view taken generally along the plane 23—23 in FIG. 22.

A third embodiment of the closure of the present invention is illustrated in FIG. 21–23 and is designated therein generally by the reference numeral 40B. The closure 40B includes a body 50B and lid 49B. The lid 49B and closure body 50B are substantially identical with the first embodiment lid 49 and closure body 50, respectively, described above with reference to the first embodiment illustrated in FIGS. 1–17. However, in the third embodiment illustrated in FIGS. 21–23, the closure body 50B includes a unique guide rail system for guiding the movement of the lid 49B to the retracted position (illustrated in FIGS. 22 and 23).

In particular, the closure body 50B has an exterior sidewall 51B with an inwardly projecting, central rail 251B for guiding the top surface of the lid 49B as the lid moves down into the closure body.

The closure body 50B also includes a pair of spaced-apart L-shaped guide rails 253B and 255B. The guide rails 253B and 255B project downwardly from the underside of the closure deck 56B and extend inwardly from the closure body exterior wall 51B. The guide rails 253B and 255B guide the feet of the lid legs 170B as the lid 49B is lowered to the vertical, fully opened, retracted position illustrated in FIGS. 22 and 23.

It will be appreciated that the lid 49B may be provided with legs 170B which have configurations different from that illustrated. With such different designs, the guide rails 253B and 255B could be modified as necessary to provide the guidance function for such modified lid legs.

It will also be appreciated that the guide rails 253B and 255B could be modified to include a positional lock or restraint structure that would grip and hold the lid 49B in the vertical, open, retracted position illustrated in FIGS. 22 and 23. For example, the lower end of each rail 253B and 255B could be provided with a protuberance or indentation for mating with an indentation or protuberance, respectively, on the adjacent lid leg.

Further, the rails could be provided with a contoured structure terminating in a pocket larger than the feet of the corresponding lid legs, and the pockets would receive the lid leg feet in a snap-fit engagement at the bottom of the guide rails. Alternatively, other forms of dimensional interference could be provided.

It will be appreciated that the closure of the present invention provides a system for covering an opening to a container with a lid. Further, the lid is movable from the closed position to an open position wherein the lid is retracted into the closure and is therefore in a position which not only renders the open closure more aesthetically pleasing but which also prevents the lid from interfering with the dispensing of the product from the container. Additionally, the retracted lid does not interfere with the viewing of the dispensing process.

It will also be appreciated that the closure of the present invention may be provided with a variety of dispensing passage structures. Although the illustrated embodiments employ a cartridge with a flexible slit-type dispensing valve in the dispensing passage, such a cartridge and dispensing valve may be omitted. Instead, the closure body may be provided with a deck defining a dispensing passage that can be directly sealed by the closure lid. The closure lid may have a suitable structure for plugging and sealing such a dispensing passage. The dispensing passage in the closure body may be sealed directly by a plug protruding downwardly from the underside of the lid. Alternatively, the closure body may include an upwardly projecting spout, and the lid may include a projecting collar for engaging either the inside or outside of the spout.

If the closure of the present invention is employed on a container for discrete articles, such as pills or the like, it may not be necessary to provide a projecting member on either the lid or the closure body deck for establishing a liquid-tight seal. The lid may instead have a substantially flat underside for merely lying across the dispensing passage. If an initial air-tight seal is desired in such an application, the closure could be covered with a conventional shrink wrap film or the like.

It will be readily observed from the foregoing detailed description of the invention and from the illustrations thereof that numerous other variations and modifications may be effected without departing from the true spirit and scope of the novel concepts or principles of this invention.

What is claimed is:

1. A closure for an opening to a container interior, said closure comprising:

a body for mounting to said container at said opening, said body having a recessed deck defining a dispensing passage for communicating between the container exterior and interior, and said body defining a recess below said deck and defined separately from said dispensing passage by a portion of said deck; and a lid having an occluding portion for occluding said dispensing passage, said lid being movable between (1) a closed position for overlying said deck around said dispensing passage to cover said dispensing passage, and (2) an open position wherein said lid is retracted into said recess in a storage orientation with at least said occluding portion located below said deck permitting the dispensing of the container contents.

2. The closure in accordance with claim 1 in which said body defines one of a snap-fit bead and a thread for engaging a mating structure on said container.

3. The closure in accordance with claim 1 for use on a container having an upwardly projecting, reduced-diameter neck defining said opening and in which said closure body includes (1) an interior collar for mounting to said container neck, and (2) an exterior housing around said collar;

said recess is defined below said deck between said interior collar and said exterior housing; and said deck defines an opening to said recess.

4. The closure in accordance with claim 3 in which said closure body has an upper surface; and said deck is recessed from said upper surface.

5. The closure in accordance with claim 3 in which said lid includes a lower surface for overlying said deck when said lid is in said closed position; and said lid occluding portion is defined by a convex protuberance for projecting from said lower surface into said dispensing passage when said lid is in said closed position.

6. The closure in accordance with claim 3 in which said closure body includes a valve mounted below said dispensing passage adjacent the underside of said deck.

7. The closure in accordance with claim 1 in which said lid has a front end;

said lid has a rear end for overlying at least a portion of said recess when said lid is in said closed position;

said lid has a pair of spaced-apart legs projecting into said recess when said lid is in said closed position; and each said leg has a foot projecting laterally under said deck when said lid is in said closed position whereby a pivot axis is defined along a line of contact between said foot and said deck when said lid is swung open by lifting said lid front end.

8. The closure in accordance with claim 1 in which said closure body deck opens to said recess whereby, when said lid is in said closed position, a portion of said lid can project out of said recess; and said lid is sized to produce an interference friction slip fit with said body adjacent said recess when said lid is in said open position.

9. The closure in accordance with claim 8 in which said lid has a front end and a rear end; and the lateral dimension of said lid increases from said rear end to said front end.

10. The closure in accordance with claim 1 in which said lid has a pair of projecting legs received in said recess; and each said leg has a laterally projecting foot for engaging said closure body when said lid is pivotally swung toward and away from said closed position.

11. The closure in accordance with claim 10 in which said closure body deck defines said dispensing passage at a location spaced from said recess and also defines an opening to said recess; and said legs are resiliently deformable to accommodate inward flexing during assembly of said lid and said closure body with said feet passing through said deck opening to said recess and snapping outwardly under said deck to retain said lid on said closure body.

12. The closure in accordance with claim 1 in which said lid has two lateral margins; and said closure body includes two resiliently deformable wall portions each projecting over a lateral margin of said lid to latch said lid in said closed position.

13. The closure in accordance with claim 1 in which said closure body includes guide rails along said recess for guiding said lid as said lid is moved in said recess to said open position.

14. A closure for an opening to a container interior wherein said container has an upwardly projecting, reduced diameter neck defining said opening, said closure comprising:

a body for mounting to said container at said opening, said body defining a dispensing passage for communicating between the container exterior and interior, and said body defining a recess, said body including (1) an interior collar for mounting to said container neck, (2) a deck defining said dispensing passage, and (3) an exterior housing around said collar, said recess being defined between said interior collar and said exterior housing; and a lid movable between a closed position for covering said dispensing passage and an open position wherein said lid is retracted into said recess in a storage orientation permitting the dispensing of the container contents, said lid having a front end defining an outwardly projecting lift tab for being grasped to lift said lid and swing said lid to a vertical position in which said lid can be lowered into said recess and supported therein by engagement of said lift tab with said deck.

15. A closure for an opening to a container interior wherein said container has an upwardly projecting, reduced-diameter neck defining said opening, said closure comprising:

a body including (1) an interior collar for mounting to said container neck, (2) an exterior housing around said collar defining a recess between said collar and said housing, and (3) a recessed deck defining (i) an opening to said recess, and (ii) a dispensing passage for being positioned over said container opening, said recess located at an elevation below said deck and separately defined from said dispensing passage by a portion of said deck; and a lid having an occluding portion for occluding said dispensing passage, said lid being movable between (1) a closed position overlying said deck around said dispensing passage to cover said lid, and (2) an open position wherein said lid is retracted into said recess in a storage orientation with at least said occluding portion located below said deck permitting the dispensing of the container contents, said lid having a front end, said lid having a rear end for overlying at least a portion of said recess when said lid is in said closed position, said lid having a pair of spaced-apart legs projecting into said recess when said lid is in said closed position, and each said leg having a foot projecting laterally under said deck when said lid is in said closed position whereby a pivot axis is defined along a line of contact between said foot and said deck when said lid is swung open by lifting said lid front end.

16. The closure in accordance with claim 15 in which said lid is sized to produce an interference friction slip fit with said body adjacent said recess when said lid is in said open position.

17. The closure in accordance with claim 16 in which the lateral dimension of said lid increases from said rear end to said front end.

18. The closure in accordance with claim 15 in which said legs are resiliently deformable to accommodate inward flexing during assembly of said lid and said closure body with said feet passing through said deck opening to said recess and snapping outwardly under said deck to retain said lid on said closure body.

19. The closure in accordance with claim 15 in which said lid has two lateral margins; and said closure body includes two resiliently deformable wall portions each projecting over a lateral margin of said lid to latch said lid in said closed position.

20. The closure in accordance with claim 15 in which said closure body includes guide rails along said recess for guiding said lid as said lid is moved in said recess to said open position.

21. The closure in accordance with claim 15 in which said interior collar defines one of a snap-fit bead and a thread for engaging a mating structure on said container neck.

22. The closure in accordance with claim 15 in which said lid includes a lower surface for overlying said deck when said lid is in said closed position; and said lid includes a convex protuberance for projecting from said lower surface into said dispensing passage when said lid is in said closed position.

23. The closure in accordance with claim 15 in which said closure body includes a valve mounted below said dispensing passage adjacent the underside of said deck.

24. The closure in accordance with claim 15 in which said lid has an exterior surface and said closure body exterior housing includes an inwardly projecting guide rail for guiding the exterior surface of said lid when said lid is moved to said retracted, open position.

25. A closure for an opening to a container interior wherein said container has an upwardly projecting, reduced-diameter neck defining said opening, said closure comprising:

a body including (1) an interior collar for mounting to said container neck, (2) an exterior housing around said collar defining a recess between said collar and said housing, and (3) a deck defining (i) an opening to said recess, and (ii) a dispensing passage for being positioned over said container opening; and a lid movable between a closed position wherein said dispensing passage is covered by said lid and an open position wherein said lid is retracted into said recess in a storage orientation permitting the dispensing of the container contents, said lid having a front end, said lid having a rear end for overlying at least a portion of said recess when said lid is in said closed position, said lid having a pair of spaced-apart legs projecting into said recess when said lid is in said closed position, and each said leg having a foot projecting laterally under said deck when said lid is in said closed position whereby a pivot axis is defined along a line of contact between said foot and said deck when said lid is swung open by lifting said lid front end, said lid front end defining an outwardly projecting lift tab for being grasped to lift said lid and swing said lid to a vertical position in which said lid can be lowered into said recess and supported therein by engagement of said lift tab with said deck.

26. A closure for an opening to a container interior wherein said container has an upwardly projecting, reduced-diameter neck defining said opening, said closure comprising:

a body including (1) an interior collar for mounting to said container neck, (2) an exterior housing around said collar defining a recess between said collar and said housing, and (3) a deck defining (i) an opening to said recess, and (ii) a dispensing passage for being positioned over said container opening; and a lid movable between a closed position wherein said dispensing passage is covered by said lid and an open position wherein said lid is retracted into said recess in a storage orientation permitting the dispensing of the container contents, said lid having a front end, said lid having a rear end for overlying at least a portion of said recess when said lid is in said closed position, said lid having a pair of spaced-apart legs projecting into said recess when said lid is in said closed position, and each said leg having a foot projecting laterally under said deck when said lid is in said closed position whereby a pivot axis is defined along a line of contact between said foot and said deck when said lid is swung open by lifting said lid front end, said lid having a bottom surface, said lid having a protuberance projecting from said bottom surface, and said closure body defining a pair of space-dapart guide rails for receiving between them and guiding said lid protuberance when said lid is moved to said open, retracted position.

27. A closure for an opening to a container interior wherein said container has an upwardly projecting, reduced-diameter neck defining said opening, said closure comprising:

a body including (1) an interior collar for mounting to said container neck, (2) an exterior housing around said collar defining a recess between said collar and said housing, and (3) a deck defining (i) an opening to said recess, and (ii) a dispensing passage for being positioned over said container opening; and a lid movable between a closed position wherein said dispensing passage is covered by said lid and an open position wherein said lid is retracted into said recess in a storage orientation permitting the dispensing of the container contents, said lid having a front end, said lid having a rear end for overlying at least a portion of said recess when said lid is in said closed position, said lid having a pair of spaced-apart legs projecting into said recess when said lid is in said closed position, and each said leg having a foot projecting laterally under said deck when said lid is in said closed position whereby a pivot axis is defined along a line of contact between said foot and said deck when said lid is swung open by lifting said lid front end, said closure body defining a pair of spaced-apart L-shaped guide rails for guiding an adjacent one of said lid legs when said lid is moved to said retracted open position.

* * * * *